United States Patent [19]

Walton et al.

[11] Patent Number: 4,683,965

[45] Date of Patent: Aug. 4, 1987

[54] TRIANGULAR OIL WELL DRILL BIT FOR USE IN UNCONSOLIDATED FORMATIONS

[76] Inventors: Paul G. Walton, 211 Hamner Dr., Houma, La. 70364; Percy A. Little, 5825 Cherokee La., Alexandria, La. 71301

[21] Appl. No.: 882,228

[22] Filed: Jul. 7, 1986

[51] Int. Cl.[4] ..... E21B 10/26; E21B 10/60

[52] U.S. Cl. ..... 175/385; 175/393

[58] Field of Search ..... 175/329, 385, 409, 379, 175/394, 397, 391, 398, 400, 401, 411, 393; 408/144, 145

[56] References Cited

U.S. PATENT DOCUMENTS 3,043,384 7/1962 Gault et al. ..... 175/391

3,145,790 8/1964 Bridwell et al. ..... 175/409

4,515,227 5/1985 Cerkovnik ..... 175/385 X

FOREIGN PATENT DOCUMENTS 840272 6/1981 U.S.S.R. ..... 175/327

*Primary Examiner*—Stephen J. Novosad

*Assistant Examiner*—Hoang C. Dang

*Attorney, Agent, or Firm*—Pravel, Gambrell, Hewitt & Kimball

[57] ABSTRACT

A drill bit for use in unconsolidated formations includes a generally triangular cross-section that tapers toward the lower tip end of the tool. The vertices of the triangular cross-section carry blade members that cut and define the size of the bore hole. Nozzles positioned between the blades and upon the tapered portion of the tool break up unconsolidated formation material that has been cut.

8 Claims, 6 Drawing Figures

TRIANGULAR OIL WELL DRILL BIT FOR USE IN UNCONSOLIDATED FORMATIONS

BACKGROUND OF THE INVENTION

The present invention relates to oil well drill bits, and more particularly relates to an improved unitary drill bit having particular utility when drilling in soft to medium unconsolidated formations.

When drilling for oil in soft to medium unconsolidated formations such as those formations found along the Louisiana and Texas Gulf Coast areas of the United States, and in offshore waters of the Gulf of Mexico, "bit balling" is a very common problem. This problem relates to a heavy accumulation of the clay-like unconsolidated formation material around the bit as it rotates through the formation. The formation material actually adheres to the bit rather than flowing away after being cut.

Several patents relate to drill bits used in oil and gas well drilling operations. For example, the Christian U.S. Pat. No. 2,169,223 entitled "Drilling Apparatus" relates to a drill bit which is used for flushing fluid into the bore along with the drill. The Christian device uses a flushing fluid that is forced down through the drill stem and passes through openings at the lowermost end portion of the drill bit. Flushing fluid will then return around the drill and the drill stem removing clogging material from the well bore. The Christian device uses a drill having an axial bore extending from the upper to the lower end of the drill and having an inside seat around the bore. A discharge channel leads downwardly from the bore above the seat and of a tubular barrel shaped to fit through the bore. The Christian device uses two blades which are a fish tail type bit construction. Because of the outwardly extending enlarged fish tail type cutters of Christian, excessive torque can be generated in the drill string. Further, these outwardly extending fish tail type cutters can ball up in unconsolidated type formations known in the industry as "gumbo mud" or like formations.

Another fish tail type bit is the Scott U.S. Pat. No. 1,733,241 entitled "Method of Producing A Hard Surface on Tools and the Like." Scott discusses applying tungsten carbide using an atomic hydrogen torch to generate enough heat to melt the carbide itself. The tungsten carbide in molten condition then forms an alloy with the blade of the cutter according to the Scott patent.

U.S. Pat. No. 2,490,208 issued to H. E. Conklin and entitled "Soft Formation Core Bit Cutter Head" shows a tubular drill bit having outwardly extending cutter blades mounted upon a conically shaped bit which is round in cross-section.

Other patents showing various constructions for drill bits include U.S. Pat. Nos. 2,169,223; 1,887,372; 2,838,284; 2,673,716; and 2,756,023.

SUMMARY OF THE INVENTION

The present invention is an improvement over prior art drill bits, providing a unitary drill bit having a generally triangularly shaped cross-section which also narrows at its tip portion, providing three cutting blade portion at the apex of the triangular cross-section of the bit and three flat surfaces spanning between the cutting blades which enhance flow characteristics, i.e., the removal of cuttings using drilling fluids as the cuttings are removed from the well bore. Jets are provided between the blades and positioned on the flow surface areas to blast and remove cuttings instantly as they are removed from the well bore. The generally triangular shape of the drill bit body minimizes bit balling, swabbing, and surging while thrusting the tool into and out of the well bore with the drill string. The device can even be used for directional drilling by using jets of different sizes such as, for example, two small jets on two sides and one large jet on the third side. Thus, the direction and angle of the hole can be controlled by the jetting procedure. The apparatus as will be described more fully hereinafter thus provides a drill bit of one-piece construction which does not have cones that can come off of the tool or ball up while drilling. The apparatus is thus stronger than common cone-type drill bits and as aforedescribed has enhanced hydraulic and flow characteristics for instantaneous removal of cuttings even in soft or unconsolidated formations such as gumbo mud as it is termed in the industry.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
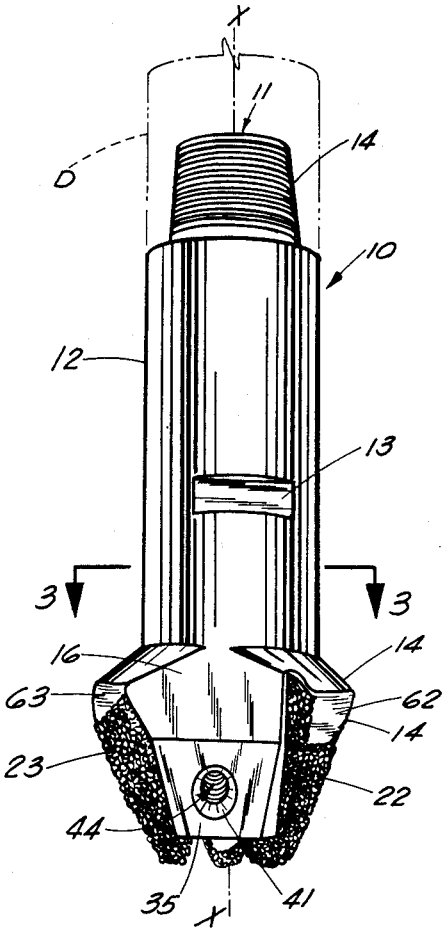
FIG. 1 is a side view of the preferred embodiment of the apparatus of the present invention.
Figure 2:
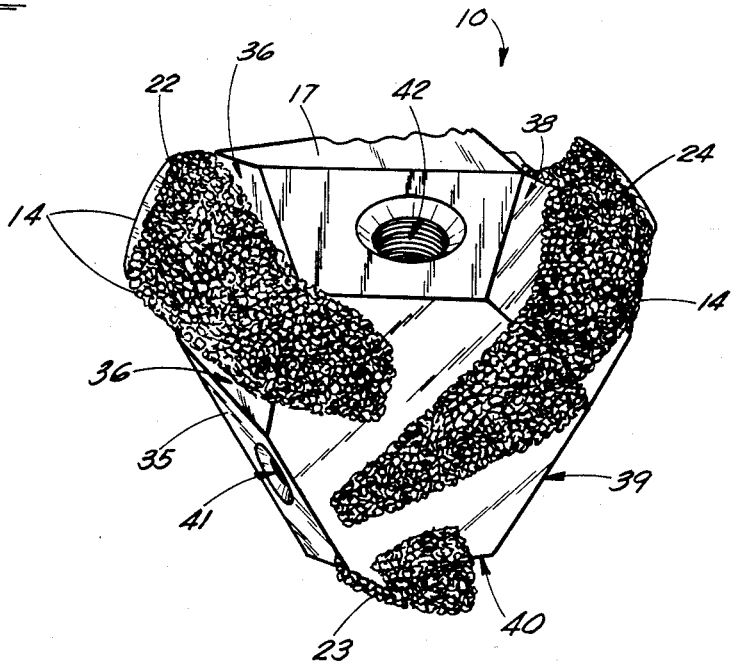
FIG. 2 is an end view of the preferred embodiment of the apparatus of the present invention.

FIGS. 1 and 2 illustrate generally the preferred embodiment of the apparatus of the present invention designated generally by the numeral 10. Drill bit 10 includes a tubular body 12 having at its upper end portion threaded section 14 which is adapted to threadably attach to a drill string D shown in phantom lines in FIG. 1. The tool body 12 can provide indentations 13 with flat surfaces, for example, so that a wrench, power tongue or the like can be attached to the tool body 12 so that the tool body 12 can be tightened with respect to the drill string D. The central longitudinal axis of tool body 12 is designated as X—X in FIG. 1. The center of cylindrical bore 11 (FIG. 3) would coincide with the central longitudinal axis of tool body 12.

The lowermost end portion of tool body 12 carries the drill bit cutting portions. An enlarged head 14 has multiple flat surfaces which intersect as will be described more fully hereinafter. Drilling head 14 includes three uppermost generally flat surfaces 16, 17, 18 which are tangent outer surface of tool body 12 (see FIGS. 3 and 4). If tool body 12 were positioned vertically, surfaces 16–18 would define vertical planes tangent the tool body 12 outer surface. The flat sides 16, 17, 18 of bit 14 define a generally triangular shape as shown by dotted lines in FIG. 3. The vertices of the triangle being schematically shown in FIG. 3 as 19, 20, 21.

Figure 3:
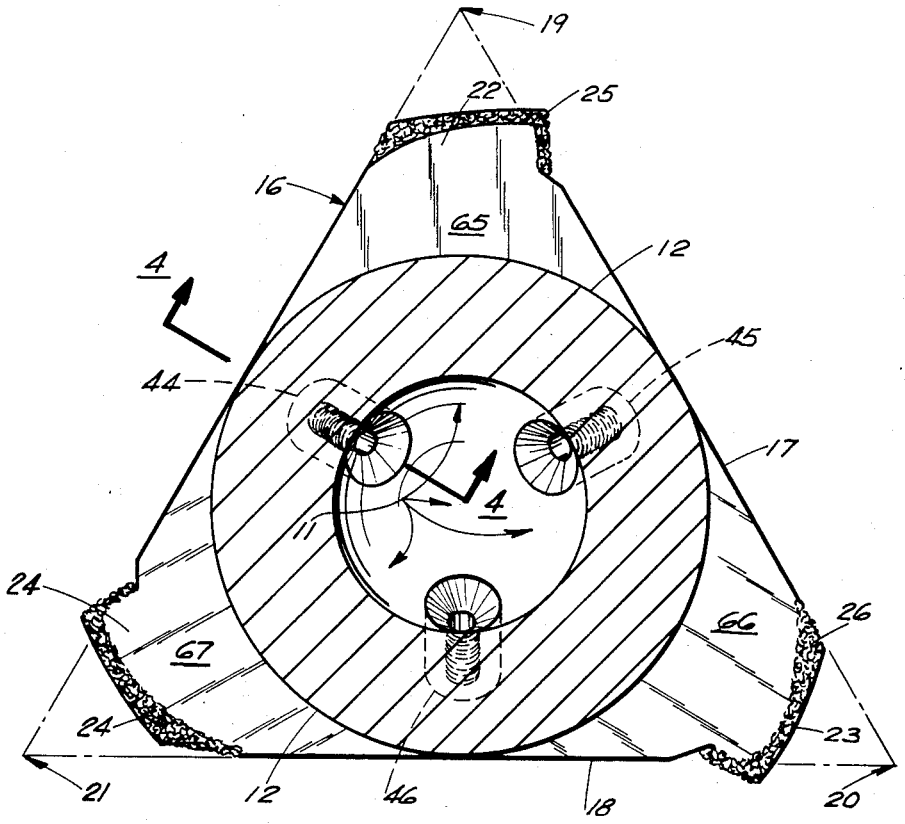
FIG. 3 is a sectional view taken along lines 3—3 of FIG. 1.
Figure 5:
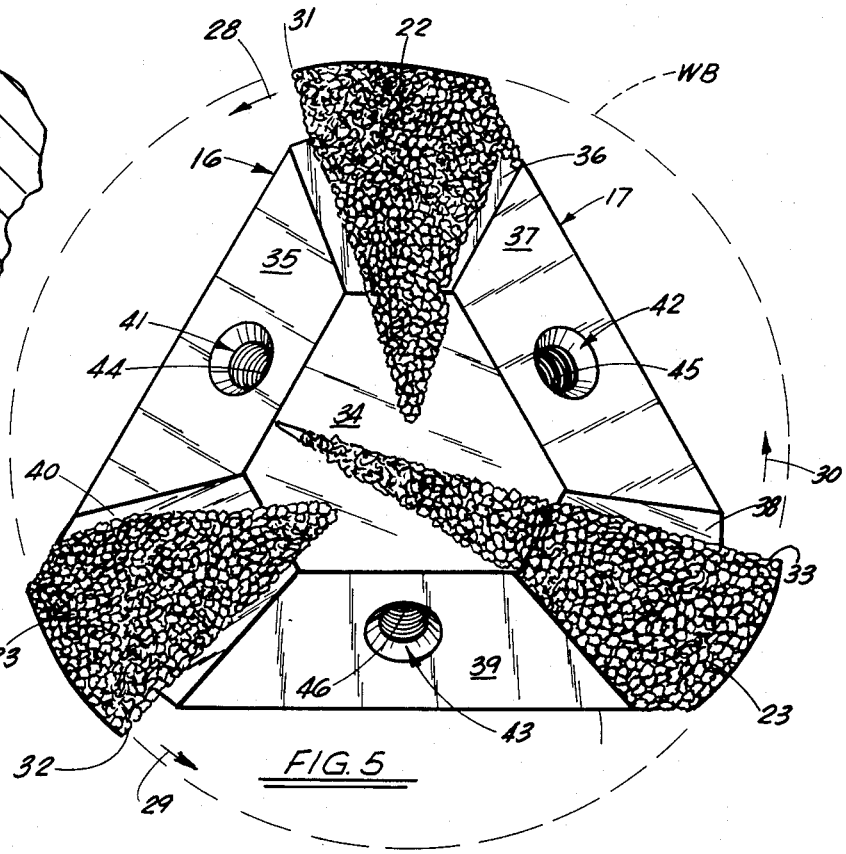
FIG. 5 is an end view of the preferred embodiment of the apparatus of the present invention.

A plurality of three cutting blades 22, 23, 24 are mounted generally at each of the vertices 19, 20, 21 as shown in FIG. 3. Each cutting blade 22–24 is covered with a layer of carbide chips, for example, 25, 26, 27. In FIG. 5, arrows 28, 29, 30 show the direction of rotation of drill bit 10 during operation. Notice that each cutting blade 22–24 provides a cutting edge generally perpendicular to the direction of rotation 28–30 of drill bit 10. In FIG. 5, the leading or cutting edge of blades 22–24 are designated by the numerals 31, 32, 33. In FIG. 5, the well bore is designated by the curved dotted circular line WB. One skilled in the art will recognize that a well bore WB of the size and configuration shown in FIG. 5 will be cut when bit 10 is rotated in the direction shown by arrows 28–30 of FIG. 5.

Figure 4:
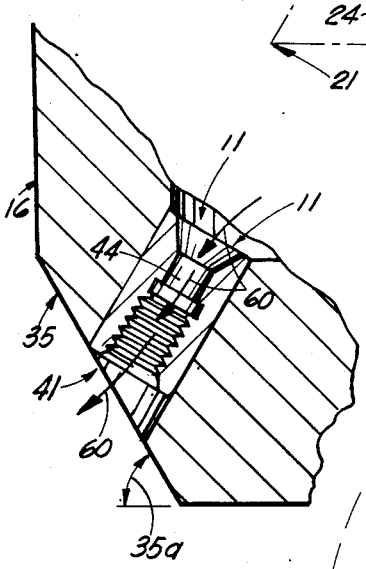
FIG. 4 is a sectional view taken along lines 4—4 of FIG. 3.

The bottom tip of bit 10 provides a flat hexagonal surface 34 (FIGS. 4–5). Six generally flat surfaces form an obtuse angle with lowermost surface 34, including the surfaces 35–40. Notice that surfaces 35, 37, 39 are smooth and uncoated surfaces having jet openings 41–43 which outcrop at surfaces 35, 37, 39. Each surface 35, 37, 39 is an inclined surface that forms an acute angle with horizontal. In FIG. 4, for example, the inclination of surface 35 is designated as angle 35*a*.

Figure 6:
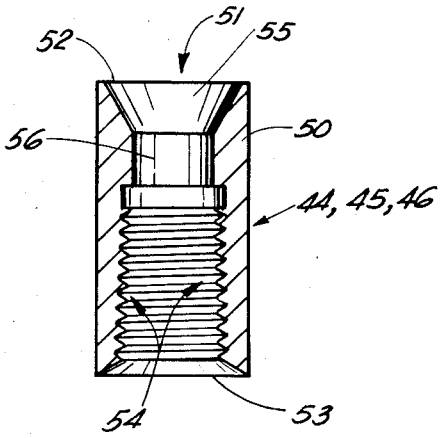
FIG. 6 is a fragmentary view illustrating the jetting assembly portion of the apparatus of the present invention.

Openings 41–43 communicate with jets 44–46 (see FIGS. 4–6). Surfaces 36, 38, 40 are covered with a layer of carbide chips.

FIG. 6 shows more particularly the construction of each jet assembly 44–46. Each jet assembly 44–46 comprises a cylindrical sleeve 50 having a bore 51 communicating with end portions 52, 53 of sleeve 50. A plurality of internal threads 54 allow insertion of a threaded jet thereinto. The end portion 52 of sleeve 50 can have frustroconical bore section 55 as well as a cylindrical bore section 56 which is positioned inwardly and communicates with the bore 11 of tool body 12 as shown in FIG. 4. In the FIG. 4, the arrows 60 schematically illustrate the flow of fluid through the jetting assembly 44.

FIG. 3 shows the communication of each jetting assembly 44–46 with the central bore 11 of tool body 12. Tool body 12 is preferably of a uniform cylindrical cross-section (see FIG. 3) between threaded section 15 and enlarged head 14. Similarly, central longitudinal bore 11 of tool body 12 is generally cylindrical as shown in FIG. 3, along its length, terminating at jetting assemblies 44–46.

The lowermost tip portion of drill bit 10 at surface 34 is seen in FIG. 5. Note that blades 22, 23, 24 extend to surface 34 with one of the blades 24 preferably extending across the surface 34 in a transverse direction as shown in FIG. 5.

In the preferred embodiment, each blade 22, 23 24 terminates at smooth surfaces 62, 63, 64. Thus, each blade 22, 23 is inclined an acuate angle with respect to vertical as best seen in FIG. 1. Surfaces 65, 66, 67 extend from the cylindrical portion of tool body 12 toward the surfaces 62, 63, 64, and define the uppermost limits of the enlarged head 14 portion of tool body 12.

The entire drill bit 10 can be manufactured of any suitable structural material such as, for example, structural steel with carbide chips covering each blade 22, 23, 24 as shown in FIGS. 1, 2, 3, and 5.

In FIG. 5, three flow zones are defined by the circular dotted line designated as well bore WB and the flat surfaces 16, 17, 18 as well as the flat inclined surfaces 35, 37, 39. During rotation of the drill bit 10, these "zones" will allow fluid to flow from jet assemblies 44, 45, 46 up to the surface and along the tool body 12 and drill string D. Because the tool is triangularly shaped, the area between the well bore wall which is designated by the dotted lines in FIG. 5 and the flat surfaces 16, 17, 18 and 35, 37, 39 will be unoccupied by structure and thus filled with fluid. This fluid is injected through the bore 11 of the tool body 12 and exits as shown in FIG. 4 through orifices 41–43. The fluid then travels upwardly carrying with it cut formation material which is removed from the well bore so that cutting will continue downwardly.

The above construction and operation provides an improved oil well drill bit that has particular utility in unconsolidated formations, commonly called "gumbo mud."

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limited sense.

What is claimed as invention is:

1. A drill bit apparatus comprising:

a. a tool body having a generally triangular horizontal cross-sectional area with a lowered tip portion;

b.means for forming a removable connection between the tool body and a drill string;

c. the tool body having an open-ended flow conveying longitudinal internal bore for circulating fluids between the tool body and a drill string connected thereto;

d. three longitudinal, radially spaced apart blade members each mounted upon the tool body;

e. three generally flat flow zone surfaces which span between the blade members that each define substantially vertical surface areas and three corresponding inclined surface areas that each respectively connect with the vertical surfaces, the substantially vertical surfaces generally defining an upper, large horizontal cross-section of the tool body and the inclined surfaces generally defining a lower, tapered section of the tool body;

f. at least one of said blade members having contact surface area means carried thereon for defining the radial dimensional limit of the tool body during a rotation of the tool body and a connected drill string; and g. one or more jets extending between the tool bore and the flat flow zone surfaces at the tapered section of the tool body above the tip portion.

2. The apparatus of claim 1 wherein the blade members are an integral portion of the tool body.

3. The apparatus of claim 1 wherein the flow zone surfaces of the lower section of the body define a channel adjacent the blade members so that cuttings and fluids can be directed away from the blade members and up the length of the tool body as a well bore hole is cut.

4. The apparatus of claim 1 wherein tungsten carbide chips are applied to the blade members.

5. The apparatus of claim 1 wherein the lower section of the tool body terminates at a generally flat end portion of the tool body.

6. The apparatus of claim 1 wherein the inclined surfaces each define acute angles with the horizontal.

7. The apparatus of claim 1 wherein each flat flow zone surface includes at least two intersecting flat surfaces of different angular orientation.

8. The apparatus of claim 5 wherein at least one of the blade members extend to the flat end portion of the tool body.

* * * * *